US005176237A

United States Patent [19]

Yang

[11] Patent Number: 5,176,237

[45] Date of Patent: Jan. 5, 1993

[54] UNATTENDED CARD EXCHANGE UNIT

[76] Inventor: Ren Guey Yang, No. 65, Sec. 4, Ba Der Road, Taipei City, Taiwan

[21] Appl. No.: 824,942

[22] Filed: Jan. 24, 1992

[51] Int. Cl.[5] ..... G07F 7/00

[52] U.S. Cl. ..... 194/211; 221/226; 221/66; 221/259

[58] Field of Search ..... 221/22, 66, 226, 258, 221/259; 194/205, 211, 240

[56] References Cited

U.S. PATENT DOCUMENTS

| | | | |
|---|---|---|---|
| 2,896,763 | 7/1959 | Gisser et al. | 194/211 X |
| 3,042,172 | 7/1962 | Bowlby | 194/211 |
| 4,650,091 | 3/1987 | Sassa et al. | 221/258 X |
| 4,887,739 | 12/1989 | Parker | 221/259 X |

*Primary Examiner*—Robert P. Olszewski
*Assistant Examiner*—Dean A. Reichard
*Attorney, Agent, or Firm*—Morton J. Rosenberg; David I. Klein

[57] ABSTRACT

An unattended card exchange unit which is powered by a battery and is actuated when a card is inserted into it via a lower passage and contact a micro-switch therein. When the unit is actuated, a motor inside there drives a driving wheel which in turn drives and rotates a first set of rubber rollers which causes the inserted card to smoothly drop down into the lower part of the unit, and a second set of rubber rollers containing an arm-carry roller, causing the arm thereof to move a card inside the unit toward an upper passage leading to a slot on outer wall of the unit.

1 Claim, 3 Drawing Sheets

UNATTENDED CARD EXCHANGE UNIT

BACKGROUND OF THE INVENTION

Cards are widely exchanged and used as a medium to transfer or communicate some messages between users because of their convenience, limited space occupation, and easiness to keep with. They are specially useful in nowaday commercial society. However, when used in a large scale show, exhibition, or other similar activities, they are usually distributed or exchanged at a lot of increased labors, time, and costs while a desired effect is not necessarily achieved and a large part of distributed cards might very possibly be wasted.

It is therefore tried by the applicant to develop an unattended card exchange unit which can be used in a show or exhibition stand to automatic exchange cards with any visitor when no one attends the exhibition floor.

SUMMARY OF THE INVENTION

The unattended card exchange unit according to the present invention mainly includes a housing, a motor, several rubber rollers with different diameters, a contact-actuated micro-switch, an arm-carry roller, a card case, a battery compartment, etc. When a card is horizontally inserted into the unattended card exchange unit via a slot, the card shall actuate the micro-switch to make the battery in the battery compartment, causing the battery to supply necessary power to the motor for the same to drive the rubber rollers. A card stored in the cardcase shall be delivered by the arm on the arm-carry roller out of the same slot through the help of rotating rollers inside the housing.

With such unattended card exchange unit, a lot of labors can be saved in a large scale show or exhibition floor and unwanted card waste can be avoided while the function of exchanging cards with visitors is effectively performed.

BRIEF DESCRIPTION OF THE DRAWINGS

The structure, objects, and characteristics of the present invention can be better understood by referring to the following detailed description of the preferred embodiment and the accompanying drawings wherein.

DETAILED DESCRIPTION OF THE PREFERRED EMBODIMENTS

Figure 1:
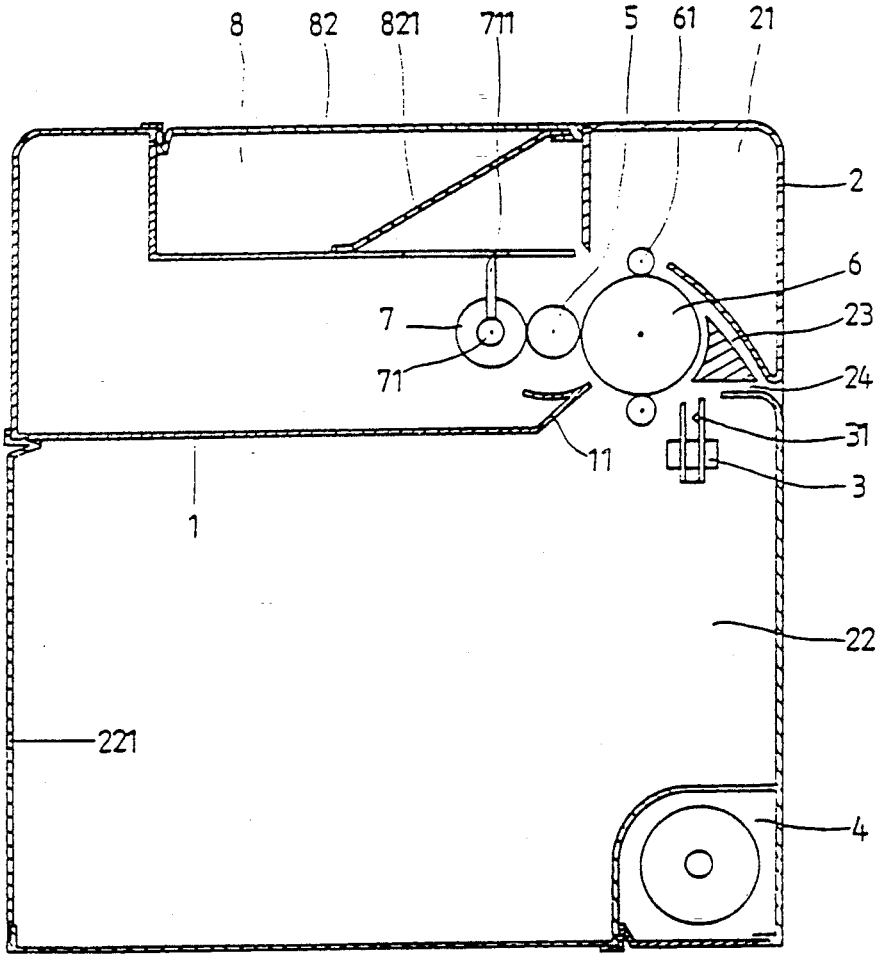
FIG. 1 is a vertically sectional view of the present invention in a non-operational state.

Please refer to FIG. 1. The present invention has a housing 2, the space in the housing 2 is divided into an upper room 21 and a lower room 22 by a partition 1 which transversely extends from oneside wall of the housing 2 and has an upward and outward inclined part at its free front end 11. A slot is formed on a sidewall of the housing 2 opposite to the partition 1. From the slot, an upper passage 23 and a lower passage 24 are further separately provided in such a manner that the upper passage 23 is slightly arcuated and extends upward and forward into the upper room 21 at an angle about 45 degrees, and the lower passage 24 straightly and horizontally extends into the upper room 21.

A contact-actuated micro-switch 3 and a battery compartment 4 are separately provided in the lower room 22, and the rest space in the lower room 22 is used to collect cards inserted into the housing through the slot. The contact-actuated micro-switch 3 is generally located near top portion of the lower room 22 below the slot and has a contact plate 31 which slightly extends into the lower passage 24, permitting a card entering the housing 1 through the lower passage 24 to first contact the contact plate 31. The battery compartment 4 is generally located at bottom of the housing 2 inside the lower room 22 below the micro-switch 3, allowing a 1.5 V battery to be accommodated therein. A door 221 may be formed on sidewall of the housing 2 preferably at a position opposite to the slot to facilitate the removal of collected cards out of the lower room 22.

A motor may be provided at a proper position in the upper room 21 for driving a driving wheel 5 in the upper room 21. When the driving wheel 5 is driven to rotate by the motor, it further drives a large rubber roller 6 at its front side near the slot and a medium rubber roller 7 at its rear side to rotate. The large rubber roller 6 further drives and rotates two small rubber rollers 61 separately contacting its top and its bottom. The contact point of the large rubber roller 6 with the top small rubber roller 61 horizontally aligns with a card being delivered to the upper passage 23 and is slightly lower than the inner end of the upper passage 23. On the other hand, the contact point of the large rubber roller 6 with the bottom small rubber roller 61 horizontally aligns with the lower passage 24 and is at an adequate distance from the upward inclined front end of the partition 1 to allow inserted card to smoothly enter the lower room 22 without being jammed over there. A arm-carry roller 71 is concentrically mounted on the medium rubber roller 7, allowing its arm 711 to be outside of the medium rubber roller 7 and suitable for moving upward to touch a stack of cards prestored in a cardcase 8 formed below the top of the housing 2 and deliver one lowest card thereof toward the upper passage 23.

Figure 2:
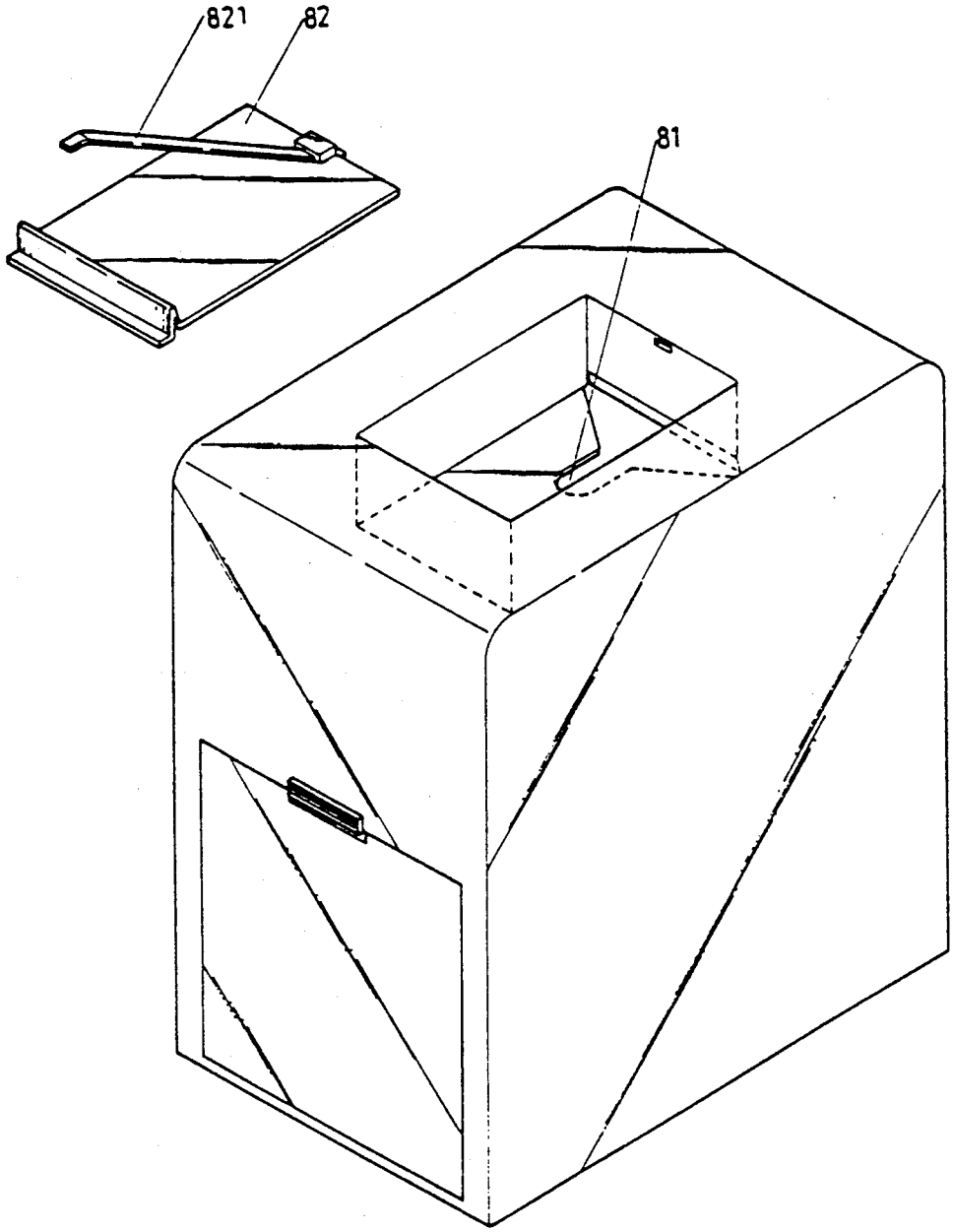
FIG. 2 is a three-dimensional perspective of the present invention, particularly illustrating a cardcase and the case cover thereof.
Figure 3:
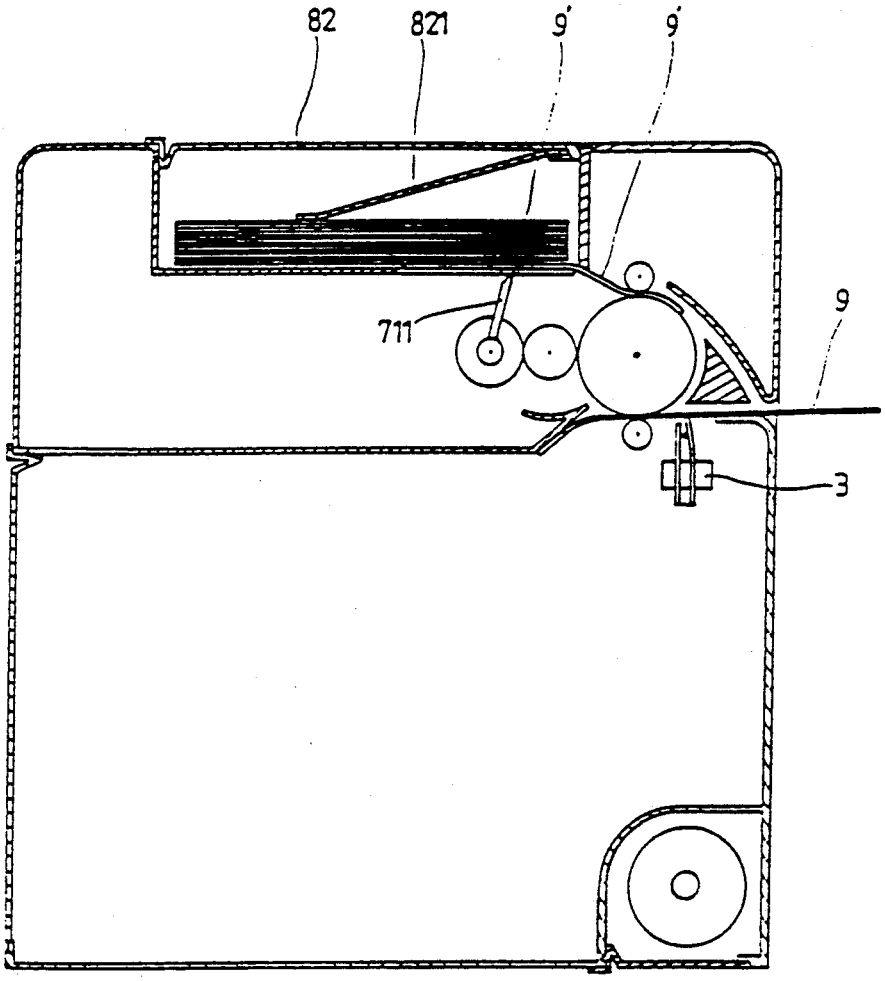
FIG. 3 is a vertically sectional view of the present invention in an operational state.

The cardcase 8 as shown in FIG. 2 is a box-like hollow case generally at center of the upper room 21 and is simultaneously formed when the housing 2 is molded. A transverse opening is formed near center of the bottom plate of the cardcase 8, just allowing the arm 711 to extend into the cardcase 8. A sidewall of the cardcase 8 adjacent to the opening 81 is chamfered at its lower inner end so as to form a slender gap between the opening 81 and the chamfered side-wall of the cardcase 8. The slender gap is in a size just big enough for a card to pass through when it is delivered by the arm 711. And the motion of the arm 711 is designed to just deliver one single card out of the cardcase 8 each time. A cover 82 is provided on top of the cardcase 8 to facilitate replenishment of cards when the previously stored cards are used up. When the cover 82 is closed to the cardcase 8, a spring plate 821 connected to its underside can just fitly press the stack of cards inside the cardcase 8, keeping the remaining cards to move down orderly. For the appearance purpose, the top surface of the housing 2 shall keep completely flat when the cover 82 is fully closed.

To use the unattended card exchange unit, just insert a card 9 into the slot, permit it to horizontally enter the lower passage 24. When the card 9 touches the contact-actuated micro-switch 3 and passes between the large rubber roller 6 and the bottom small rubber roller 61, the circuit between the micro-switch 3 and the battery compartment 4 is made, causing the battery to supply power required by the motor to drive the rubber rollers. This is the main circuit system in the present invention. The inserted card 9 keeps moving forward by means of the rotation of the large rubber roller 6 and the bottom small rubber roller 61, follows the inclined front end 11 of the partition 1, and finally drops down into the lower room 22 in the housing 2. At the same time, the arm-carry roller 71 concentrically mounted on the medium rubber roller 7 is driven to rotate, allowing the arm 711 to move toward the bottom opening 81 of the cardcase 8 and removes one card 9' out of the cardcase 8. The card 9' passes between the large rubber roller 6 and the top small rubber roller 61, enters the upper passage 23, and finally slides out of the slot. The user may now take the card 9'.

What is claimed is:

1. An unattended card exchange unit comprising:

a housing which has a partition inside it horizontally extending from one sidewall of side housing to divide inner space of said housing into an upper room and a lower room, a slot formed on a sidewall of said housing opposite to said partition, an upper passage, a lower passage, a cardcase formed below top of said housing, a battery compartment formed at bottom of said housing, and a door provided on a sidewall of said housing opposite to said slot;

said partition having an upward bended and inclined free front end;

said upper passage being slightly arcuated and extending into said upper room at an angle about 45 degrees;

said lower passage straightly and horizontally extending into said upper room;

said slot forming a common outer end of said upper and said lower passage, allowing a card to horizontally enter said lower passage or slide down out of said upper passage;

said cardcase being a box-like hollow case allowing a stack of cards to be accommodated therein, and having a cover which has a spring plate connected to underside of said cover for fitly pressing said stack of cards to facilitate the same to move downward, an opening formed at bottom of said cardcase, and a sidewall which is chamfered at its lower inner end so as to form a gap in front of said bottom opening just allowing a card to pass therethrough; and said battery compartment accommodating a battery to supply necessary power;

a contact-actuated micro-switch disposed at a proper position in said lower room, near and below said slot on said housing, with a contact plate thereof slightly extending into said lower passage;

said micro-switch making a circuit between it and said battery in said battery compartment when said contact plate is touched by a card entering said lower passage;

a motor disposed at a proper position in said upper room of said housing, using power supplied by said battery in said battery compartment when said micro-switch is actuated and causes said battery to supply power;

a driving wheel disposed in said upper room and being driven by said motor to rotate;

a large rubber roller near said slot between said upper and said lower passage, contacting said driving wheel at one side and being driven by the same to rotate;

two small rubber rollers separately contacting a top side and a bottom side of said large rubber roller, and being driven by said large rubber roller to rotate;

contact point of said large rubber roller with said top small rubber roller being horizontally aligned with said gap in front of said bottom opening of said cardcase and slightly lower than an inner opening of said upper passage, and contact of said large rubber roller with said bottom small rubber roller being horizontally aligned with an inner opening of said lower passage and being properly distant from said inclined front end of said partition for a card to smoothly drop down into said lower room;

a medium rubber roller contacting another side of said driving wheel opposite to said large rubber roller and being driving by said driven wheel to rotate; and an arm-carry roller concentrically mounted to said medium rubber roller with an arm thereof located outside of said medium rubber roller;

said arm-carry roller being able to rotate along with said medium rubber roller, causing said arm thereof to move toward and slightly extend into said bottom opening of said cardcase, and thereby removes one lowest card from said cardcase to pass said gap in front of said bottom opening as well as said contact point of said large rubber roller and said top small rubber roller, allowing said card to enter said upper passage and slide out of said slot.

* * * * *